US010559884B2

(12) United States Patent
Nikitin

(10) Patent No.: US 10,559,884 B2
(45) Date of Patent: Feb. 11, 2020

(54) WIDEBAND RFID TAG ANTENNA

(71) Applicant: INTERMEC, INC., Lynnwood, WA (US)

(72) Inventor: Pavel Nikitin, Seattle, WA (US)

(73) Assignee: INTERMEC, INC., Lynnwood, WA (US)

( * ) Notice: Subject to any disclaimer, the term of this patent is extended or adjusted under 35 U.S.C. 154(b) by 120 days.

(21) Appl. No.: 15/723,526

(22) Filed: Oct. 3, 2017

(65) Prior Publication Data

US 2019/0103677 A1 Apr. 4, 2019

(51) Int. Cl.

| | |
|---|---|
| ***H01Q 1/22*** | (2006.01) |
| ***H01Q 1/38*** | (2006.01) |
| ***H01Q 5/371*** | (2015.01) |
| ***H01Q 9/28*** | (2006.01) |

(52) U.S. Cl.

CPC ..... *H01Q 9/285* (2013.01); *H01Q 1/2216* (2013.01); *H01Q 1/2225* (2013.01); *H01Q 1/38* (2013.01); *H01Q 5/371* (2015.01)

(58) Field of Classification Search

CPC H01Q 9/065; H01Q 9/16; H01Q 9/24; H01Q 9/26; H01Q 9/285; H01Q 1/2208; H01Q 1/2216; H01Q 1/2225; H01Q 1/38; H01Q 5/307; H01Q 5/357; H01Q 5/364; H01Q 5/371

See application file for complete search history.

(56) References Cited

U.S. PATENT DOCUMENTS 6,278,413 B1 8/2001 Hugh et al.
6,975,278 B2 * 12/2005 Song ..... H01Q 9/26 343/795
7,358,908 B2 4/2008 Tran
7,486,192 B2 * 2/2009 Yamagajo ..... G06K 19/0726 340/572.5
D588,585 S 3/2009 Montgomery et al.
7,619,565 B2 11/2009 Chen et al.
7,750,864 B2 7/2010 Hilgers
8,179,329 B2 * 5/2012 Kato ..... G06K 19/07749 343/726
8,717,244 B2 5/2014 Joyce, Jr. et al.
D713,394 S 9/2014 Forster
9,390,367 B2 7/2016 Machado et al.
2016/0012329 A1 1/2016 MacHado et al.

FOREIGN PATENT DOCUMENTS

AU 784452 B2 4/2006

OTHER PUBLICATIONS

K. V. S. Rao, P. V. Nikitin and S. Lam. "Antenna design for UHF RFID Tags: A Review and a Practical Application, IEEE Transactions on Antennas and Propagation", vol. 53, No. 12, pp. 3870-3876, Dec. 2005.

* cited by examiner

*Primary Examiner* — Daniel Munoz
*Assistant Examiner* — Patrick R Holecek
(74) *Attorney, Agent, or Firm* — Oliff PLC; R. Brian Drozd

(57) ABSTRACT

A radio frequency identification (RFID) antenna is disclosed. The RFID antenna may include: a substrate; a radiator disposed on the substrate, the radiator comprising a first electrical conductor and a second electrical conductor that perpendicularly intersect a straight edge of the radiator, the first electrical conductor and the second electrical conductor being symmetrical to each other with respect to a central point of the radiator; a loop disposed on the substrate; and a stub disposed on the substrate between the loop and the central point of the radiator.

20 Claims, 14 Drawing Sheets

RFID SYSTEM

RFID TAG

*RFID SYSTEM COMMUNICATION*

RFID TAG IC COMPONENTS

SIGNAL PATH DURING R→T

SIGNAL PATH DURING T→R

800

| Designs | L1 (mm) | L2 (mm) | H1 (mm) | H2 (mm) | H3 (mm) | H4 (mm) | W1 (mm) | W2 (mm) | W3 (mm) | W4 (mm) | W5 (mm) |
|---|---|---|---|---|---|---|---|---|---|---|---|
| ETSI | 26 | 76 | 6.4 | 7 | 3 | 26 | 1 | 2 | 8 | 24 | 18 |
| FCC | 24 | 76 | 6.4 | 7 | 3 | 24 | 1 | 2.5 | 7 | 23 | 20 |

850

| Designs | L1 (λ) | L2 (λ) | H1 (λ) | H2 (λ) | H3 (λ) | H4 (λ) | W1 (λ) | W2 (λ) | W3 (λ) | W4 (λ) | W5 (λ) |
|---|---|---|---|---|---|---|---|---|---|---|---|
| ETSI | 0.075 | 0.219 | 0.018 | 0.02 | 0.009 | 0.075 | 0.003 | 0.006 | 0.023 | 0.069 | 0.052 |
| FCC | 0.073 | 0.232 | 0.02 | 0.021 | 0.009 | 0.073 | 0.003 | 0.008 | 0.021 | 0.07 | 0.061 |

1100

| Design | L1 (mm) | L2 (mm) | H1 (mm) | H2 (mm) | H3 (mm) | H4 (mm) | W1 (mm) | W2 (mm) | W3 (mm) | W4 (mm) | W5 (mm) |
|---|---|---|---|---|---|---|---|---|---|---|---|
| FCC | 23.24 | 88 | 6.4 | 4 | 6 | 16 | 0.8 | 2 | 18 | 18 | 15 |

1150

| Design | L1 (λ) | L2 (λ) | H1 (λ) | H2 (λ) | H3 (λ) | H4 (λ) | W1 (λ) | W2 (λ) | W3 (λ) | W4 (λ) | W5 (λ) |
|---|---|---|---|---|---|---|---|---|---|---|---|
| FCC | 0.071 | 0.268 | 0.02 | 0.012 | 0.018 | 0.049 | 0.002 | 0.006 | 0.055 | 0.055 | 0.046 |

WIDEBAND RFID TAG ANTENNA

BACKGROUND

Radio Frequency Identification (RFID) tags are used for many purposes, including article control in retail stores and warehouses, electronic toll collection, and tracking of freight containers. RFID tags, which include an antenna and a chip, may be attached to articles made of various types of materials, each type of material having different dielectric properties. The chip of the RFID tag may contain information uniquely identifying the article to which it is attached, where the article may be a book, a vehicle, an animal, an individual, or other tangible object.

An RFID tag antenna is typically designed for a specific chip, such as an application-specific integrated circuit (ASIC), and designed such that proper impedance match occurs between the antenna and the chip. In many cases, the RFID tag antenna is also designed for a specific high-dielectric material (e.g., a specific plastic) or a variety of low-dielectric materials (e.g., cardboard or wood), or use complicated structures where one geometrical parameter of the RFID tag antenna affects many of the other antenna parameters. RFID tag antennas are also designed with respect to specific frequency ranges.

Each country has adopted its own frequency allocation for RFID. In order for RFID equipment to be compliant with a particular country's allocated ultra-high frequency (UHF) regulations, the RFID system should be designed to operate within the country's specific frequency ranges. For example, Europe has an RFID UHF band of 866-869 MHz, North America and South America each have an RFID UHF band of 902-928 MHz, and Japan and some other Asian countries have an RFID UHF band of 950-956 MHz.

One challenge in RFID tag antenna design is the difficulty of creating an antenna that can be used on a variety of types of materials having different dielectric properties, particularly a variety of high-dielectric materials, such as different compositions of automobile glass. Another challenge is the difficulty of creating an antenna that can be used for a specific dielectric medium across all ultra-high frequencies. Thus, there is a need for an RFID antenna, which can be used across all UHF bands for a specific dielectric medium, or can be used in a single frequency band for different dielectric mediums.

SUMMARY

A wideband RFID tag antenna is provided. The antenna includes a substrate, a radiator, a matching loop and a feeding stub disposed on the substrate. A first electrical conductor and a second electrical conductor of the radiator are symmetrical to each other with respect to a central point of the radiator. The stub is disposed between the loop and the central point of the radiator. The RFID antenna may operate across all ultra-high frequencies (860 MHz-960 MHz) for a particular dielectric medium by varying the geometrical parameters of the antenna, or may operate in a single frequency band for different dielectric mediums by varying the geometrical parameters of the antenna.

BRIEF DESCRIPTION OF THE DRAWINGS

Examples of an RFID tag antenna are illustrated in the figures. The examples and figures are illustrative rather than limiting.

DETAILED DESCRIPTION OF EMBODIMENTS

Described below are example configurations of the present invention, any of which configuration can be used alone or in any combination.

Proper impedance matching between an RFID antenna and a chip, such as an ASIC, is of paramount importance in RFID technology. RFID tag antennas are typically designed for a specific ASIC, and adding an external matching network with lumped elements is usually prohibitive due to cost and fabrication issues. To overcome this situation, an antenna can be directly matched to the ASIC, which has complex impedance varying with the frequency and the input power applied to the chip. However, directly matching the antenna to the ASIC can be limiting to the designer.

Another challenge in designing and integrating RFID antennas is the difficulty of providing a single antenna design for a variety of types of materials having different dielectric properties, particularly a variety of high-dielectric materials, such as different automobile glass types having different compositions, since the dielectric properties of different glasses are likely to be highly variable.

The present application, according to various embodiments, addresses these issues.

An RFID tag antenna is provided that can be easily modified to match any ASIC parameter. For example, the tag antenna can be modified to match ASIC impedance, with separate control over the real and imaginary part. The RFID tag antenna has a very wideband performance on a variety of high-dielectric materials, such as various automobile glass types, and can be used across all ultra-high frequencies for a specific dielectric medium, or can be used in a single frequency band for different dielectric mediums. The RFID tag antenna has a dual band structure, and thus has two resonances, and has several parameters that allow one to control the two resonances as well as the antenna impedance. When placed on a variety of materials, such as different automobile glass types, the RFID tag antenna provides reliable performance.

Generally speaking, the present application may relate to a wideband RFID antenna configured to operate across all ultra-high frequencies (860 MHz-960 MHz) for a particular dielectric medium by varying the geometrical parameters of the antenna. The present application may also relate to an RFID antenna configured to operate in a single frequency band for different dielectric mediums by varying the geometrical parameters of the antenna.

Various embodiments are discussed in more depth below in combination with the drawings.

Figure 1:
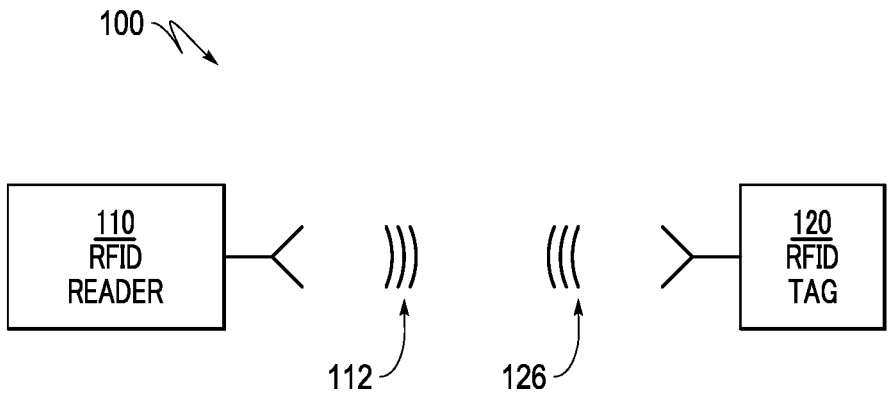
FIG. 1 is a block diagram of components of an RFID system according to embodiments.

FIG. 1 is a diagram of components of a typical RFID system 100, incorporating embodiments. An RFID reader 110 transmits an interrogating Radio Frequency (RF) wave 112. RFID tag 120 in the vicinity of RFID reader 110 may sense interrogating RF wave 112 and generate wave 126 in response. RFID reader 110 senses and interprets wave 126.

Reader 110 and tag 120 exchange data via wave 112 and wave 126. In a session of such an exchange, each encodes, modulates, and transmits data to the other, and each receives, demodulates, and decodes data from the other. The data can be modulated onto, and demodulated from, RF waveforms. The RF waveforms are typically in a suitable range of frequencies, such as those near 900 MHz, 2.4 GHz, and so on.

Encoding the data can be performed in a number of ways. For example, protocols are devised to communicate in terms of symbols, also called RFID symbols. A symbol for communicating can be a delimiter, a calibration symbol, and so on. Further, symbols can be implemented for ultimately exchanging binary data, such as "0" and "1," if that is desired. In turn, when the symbols are processed internally by reader 110 and tag 120, they can be equivalently considered and treated as numbers having corresponding values, and so on.

Tag 120 can be a passive tag, or an active or battery-assisted tag (i.e., having its own power source). Where tag 120 is a passive tag, it is powered from wave 112.

Figure 2:
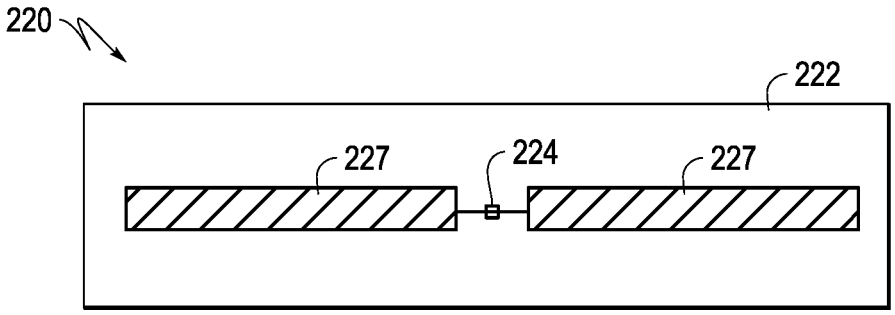
FIG. 2 is a diagram of components of an RFID tag, such as a tag that can be used in the system of FIG. 1.

FIG. 2 is a diagram of an RFID tag 220, which can be the same as tag 120 of FIG. 1. Tag 220 is implemented as a passive tag, meaning it does not have its own power source. Much of what is described in this document, however, applies also to active and battery-assisted tags.

Tag 220 is formed on a substantially planar inlay 222, which can be made in many ways known in the art. Tag 220 includes an electrical circuit which may be implemented as an integrated circuit (IC) 224. IC 224 is arranged on printed circuit board (PCB) 222.

Tag 220 also includes an antenna for exchanging wireless signals with its environment. The antenna may be flat (e.g., a microstrip) and attached to PCB 222. IC 224 is electrically coupled to the antenna via suitable antenna terminals (not shown in FIG. 2).

IC 224 is shown with a single antenna port, including two antenna terminals coupled to two antenna segments 227, which are shown here forming a dipole. Many other embodiments are possible using any number of ports, terminals, antennas, and/or segments of antennas.

In operation, a signal is received by the antenna and communicated to IC 224. IC 224 both harvests power, and responds if appropriate, based on the incoming signal and the IC's internal state. In order to respond by replying, IC 224 modulates the reflectance of the antenna, which generates backscatter 126 from wave 112 transmitted by the reader. Coupling together and uncoupling the antenna terminals of IC 224 can modulate the antenna's reflectance, as can a variety of other means.

In the embodiment of FIG. 2, antenna segments 227 are separate from IC 224. In other embodiments, antenna segments may alternatively be formed on IC 224, and so on.

The components of the RFID system of FIG. 1 may communicate with each other in any number of modes. One such mode is called full duplex. Another such mode is called half-duplex, and is described below.

Figure 3:
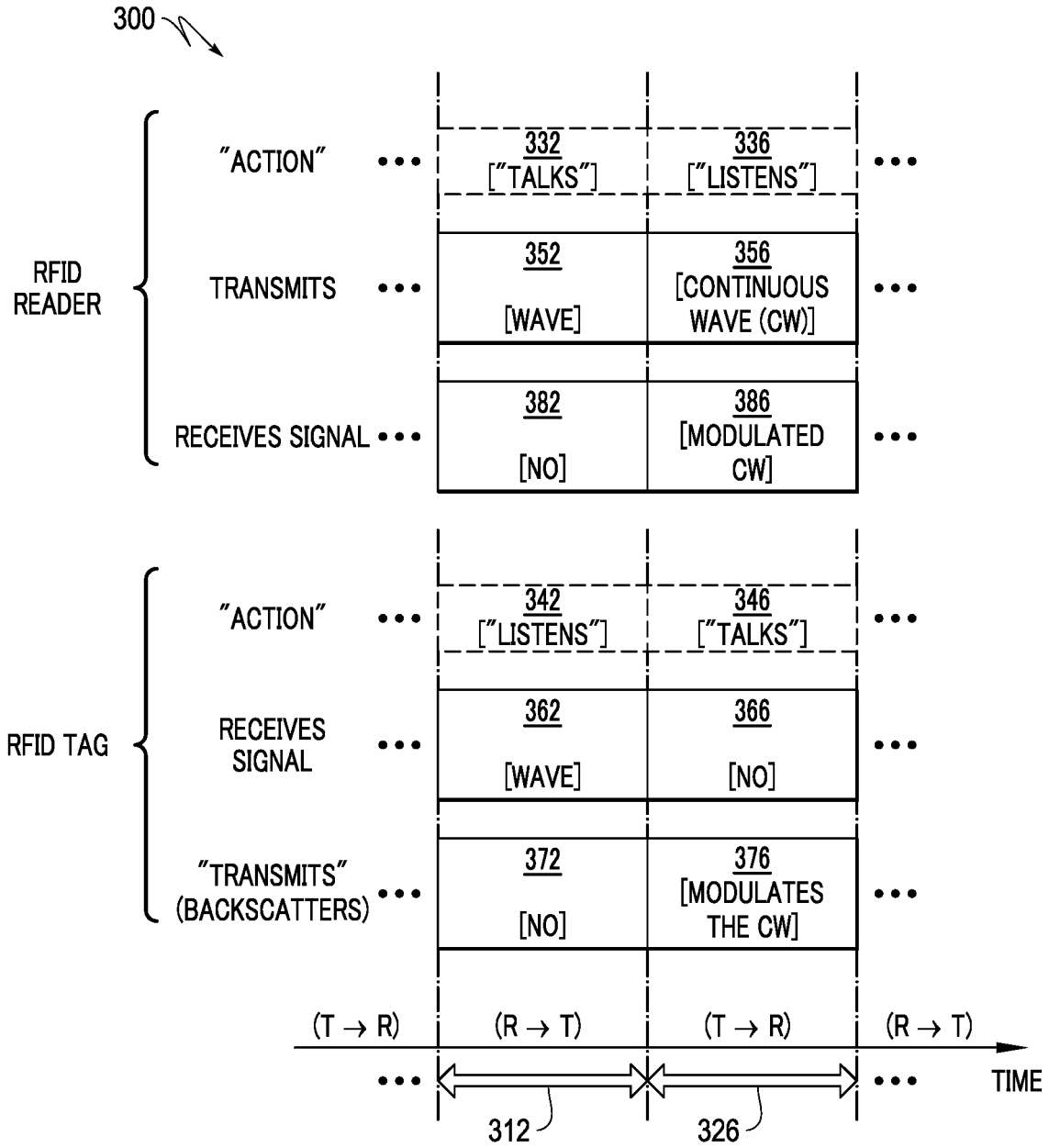
FIG. 3 is a diagram illustrating the half-duplex mode of communication between the components of the RFID system of FIG. 1.

FIG. 3 is a conceptual diagram 300 for explaining the half-duplex mode of communication between the components of the RFID system of FIG. 1, especially when tag 120 is implemented as passive tag 220 of FIG. 2. The explanation is made with reference to a TIME axis, and also with reference to a human metaphor of "talking" and "listening." The actual technical implementations for "talking" and "listening" are now described.

RFID reader 110 and RFID tag 120 talk and listen to each other by taking turns. As seen on axis TIME, when reader 110 talks to tag 120 the communication session is designated as "R→T", and when tag 120 talks to reader 110 the communication session is designated as "T→R". Along the TIME axis, a sample R→T communication session occurs during a time interval 312, and a following sample T→R communication session occurs during a time interval 326. Of course interval 312 is typically of a different duration than interval 326—here the durations are shown approximately equal only for purposes of illustration.

According to blocks 332 and 336, RFID reader 110 talks during interval 312, and listens during interval 326. According to blocks 342 and 346, RFID tag 120 listens while reader 110 talks (during interval 312), and talks while reader 110 listens (during interval 326).

In terms of technical behavior, during interval 312, reader 110 talks to tag 120 as follows. According to block 352, reader 110 transmits wave 112, which was first described in FIG. 1. At the same time, according to block 362, tag 120 receives wave 112 and processes it, to extract data and so on. Meanwhile, according to block 372, tag 120 does not backscatter with its antenna, and according to block 382, reader 110 has no wave to receive from tag 120.

During interval 326, tag 120 talks to reader 110 as follows. According to block 356, reader 110 transmits a Continuous Wave (CW), which can be thought of as a carrier signal that ideally encodes no information. As discussed before, this carrier signal serves both to be harvested by tag 120 for its own internal power needs, and also as a wave that tag 120 can backscatter. Indeed, during interval 326, according to block 366, tag 120 does not receive a signal for processing. Instead, according to block 376, tag 120 modulates the CW emitted according to block 356, so as to generate backscatter wave 126. Concurrently, according to block 386, reader 110 receives backscatter wave 126 and processes it.

Figure 4:
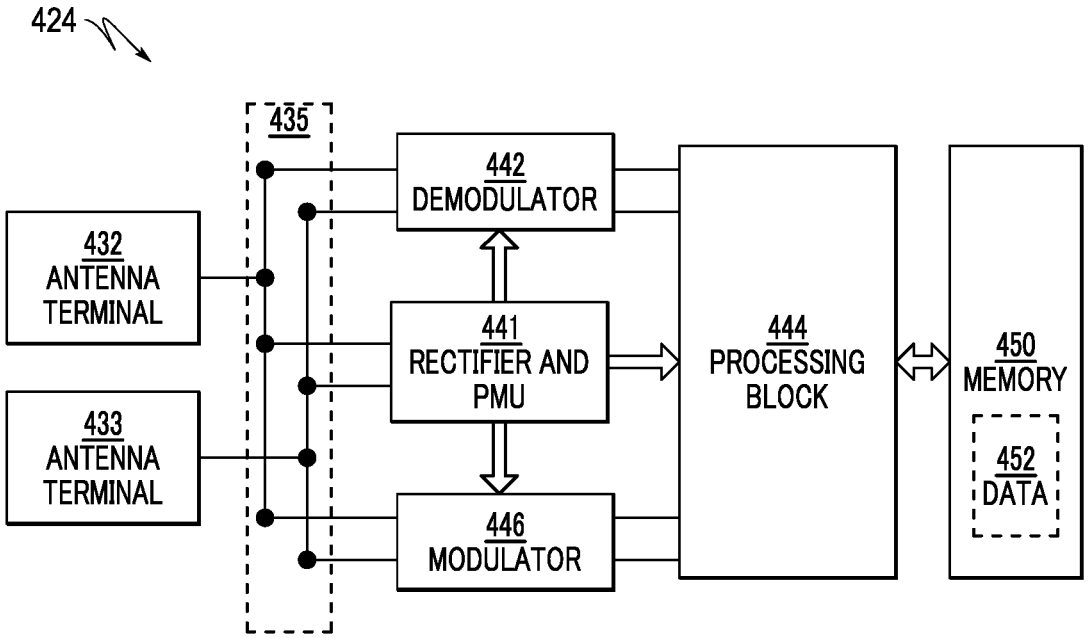
FIG. 4 is a block diagram illustrating an RFID IC, such as the RFID IC shown in FIG. 2.

FIG. 4 is a block diagram showing a detail of an RFID IC, such as the one shown in FIG. 2. Electrical circuit 424 in FIG. 4 may be formed in an IC of an RFID tag, such as IC 224 of FIG. 2. Circuit 424 has a number of main components that are described in this document. Circuit 424 may have a number of additional components from what is shown and described, or different components, depending on the exact implementation.

Circuit 424 shows two antenna terminals 432, 433, which are suitable for coupling to antenna segments such as segments 227 of RFID tag 220 of FIG. 2. When two antenna terminals form a signal path with an antenna they are often referred-to as an antenna port. Antenna terminals 432, 433 may be made in any suitable way, such as using pads and so on. In many embodiments more than two antenna terminals are used, especially when more than one antenna port or more than one antenna is used.

Circuit 424 includes a section 435. Section 435 may be implemented as shown, for example as a group of nodes for proper routing of signals. In some embodiments, section 435 may be implemented otherwise, for example to include a receive/transmit switch that can route a signal, and so on.

Circuit 424 also includes a Rectifier and PMU (Power Management Unit) 441. Rectifier and PMU 441 may be implemented in any way known in the art, for harvesting raw RF power received via antenna terminals 432, 433. In some embodiments, block 441 may include more than one rectifier.

In operation, an RF wave received via antenna terminals 432, 433 is received by Rectifier and PMU 441, which in turn generates power for the electrical circuits of IC 424. This is true for either or both reader-to-tag (R→T) and tag-to-reader (T→R) sessions, whether or not the received RF wave is modulated.

Circuit 424 additionally includes a demodulator 442. Demodulator 442 demodulates an RF signal received via antenna terminals 432, 433. Demodulator 442 may be implemented in any way known in the art, for example including an attenuator stage, an amplifier stage, and so on.

Circuit 424 further includes a processing block 444. Processing block 444 receives the demodulated signal from demodulator 442, and may perform operations. In addition, it may generate an output signal for transmission.

Processing block 444 may be implemented in any way known in the art. For example, processing block 444 may include a number of components, such as a processor, memory, a decoder, an encoder, and so on.

Circuit 424 additionally includes a modulator 446. Modulator 446 modulates an output signal generated by processing block 444. The modulated signal is transmitted by driving antenna terminals 432, 433, and therefore driving the load presented by the coupled antenna segment or segments. Modulator 446 may be implemented in any way known in the art, for example including a driver stage, amplifier stage, and so on.

In one embodiment, demodulator 442 and modulator 446 may be combined in a single transceiver circuit. In another embodiment, modulator 446 may include a backscatter transmitter or an active transmitter. In yet other embodiments, demodulator 442 and modulator 446 are part of processing block 444.

Circuit 424 additionally includes a memory 450, which stores data 452. Memory 450 is preferably implemented as a Nonvolatile Memory (NVM), which means that data 452 is retained even when circuit 424 does not have power, as is frequently the case for a passive RFID tag.

In terms of processing a signal, circuit 424 operates differently during a R→T session and a T→R session. The different operations are described below, in this case with circuit 424 representing an IC of an RFID tag.

Figure 5A:
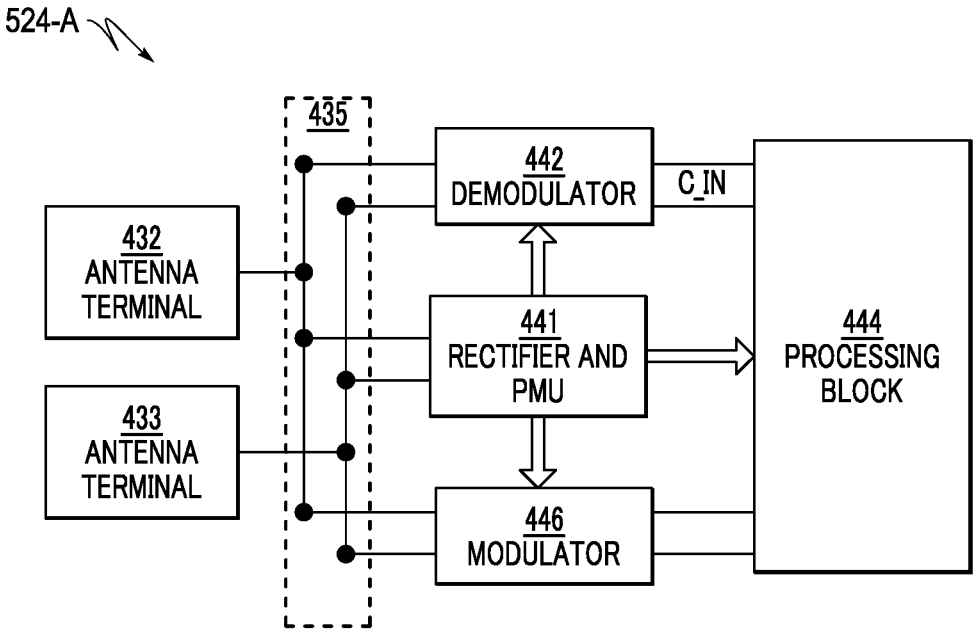
FIG. 5A is a block diagram of a version of the components of the circuit FIG. 4, illustrating a signal operation during a reader-to-tag session.

FIG. 5A shows version 524-A of components of circuit 424 of FIG. 4, further modified to emphasize a signal operation during a R→T session (receive mode of operation) during time interval 312 of FIG. 3. An RF wave is received from antenna terminals 432, 433, and then a signal is demodulated from demodulator 442, and then input to processing block 444 as C_IN. In one embodiment, C_IN may include a received stream of symbols.

Version 524-A shows as relatively obscured those components that do not play a part in processing a signal during a R→T session. Indeed, Rectifier and PMU 441 may be active, but only in converting raw RF power. And modulator 446 generally does not transmit during a R→T session. Modulator 446 typically does not interact with the received RF wave significantly, either because switching action in section 435 of FIG. 4 decouples the modulator 446 from the RF wave, or by designing modulator 446 to have a suitable impedance, and so on.

While modulator 446 is typically inactive during a R→T session, it need not be always the case. For example, during a R→T session, modulator 446 could be active in other ways. For example, it could be adjusting its own parameters for operation in a future session.

Figure 5B:
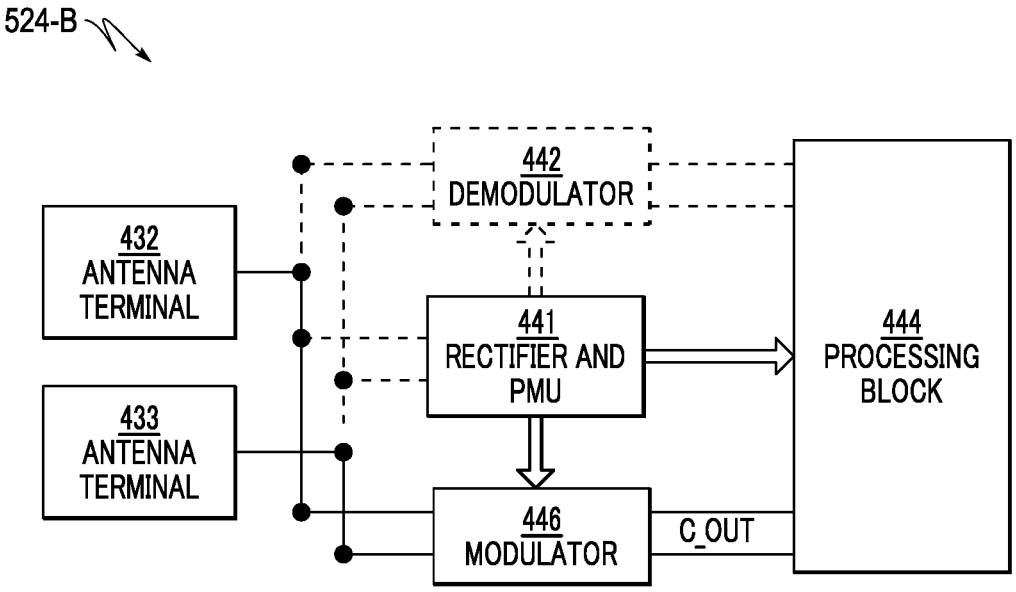
FIG. 5B is a block diagram of a version of components of the circuit of FIG. 4, illustrating a signal operation during a tag-to-reader session.

FIG. 5B shows version 524-B of components of circuit 424 of FIG. 4, further modified to emphasize a signal operation during a T→R session during time interval 326 of FIG. 3. A signal is output from processing block 444 as C_OUT. In one embodiment, C_OUT may include a transmission stream of symbols. C_OUT is then modulated by modulator 446, and output as an RF wave via antenna terminals 432, 433.

Version 524-B shows as relatively obscured those components that do not play a part in processing a signal during a T→R session. Indeed, Rectifier and PMU 441 may be active, but only in converting raw RF power. And demodulator 442 generally does not receive during a T→R session. Demodulator 442 typically does not interact with the transmitted RF wave, either because switching action in section 435 decouples the demodulator 442 from the RF wave, or by designing demodulator 442 to have a suitable impedance, and so on.

While demodulator 442 is typically inactive during a T→R session, it need not be always the case. For example, during a T→R session, demodulator 442 could be active in other ways. For example, it could be adjusting its own parameters for operation in a future session.

In embodiments, demodulator 442 and modulator 446 are operable to demodulate and modulate signals according to a protocol, such as Version 1.2.0 of the Class-1 Generation-2 UHF RFID Protocol for Communications at 860 MHz-960 MHz ("Gen2") by EPCglobal, Inc., which is hereby incorporated by reference. In embodiments where electrical circuit 424 includes multiple demodulators and/or multiple modulators, each may be configured to support different protocols or different sets of protocols. A protocol represents, in part, how symbols are encoded for communication, and may include a set of modulations, encodings, rates, timings, or any suitable parameters associated with data communications.

Figure 6A:
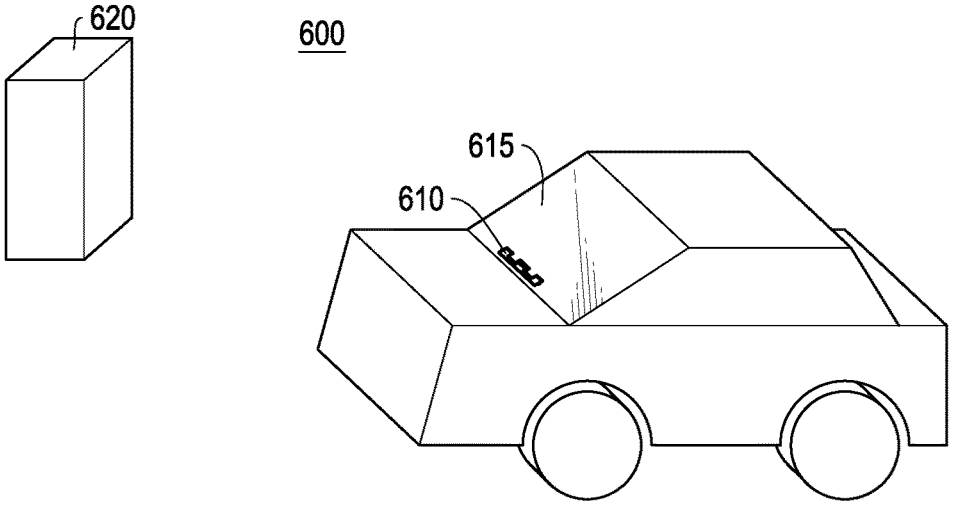
FIG. 6A is a system including an RFID tag and RFID reader, according to an embodiment.
Figure 6B:
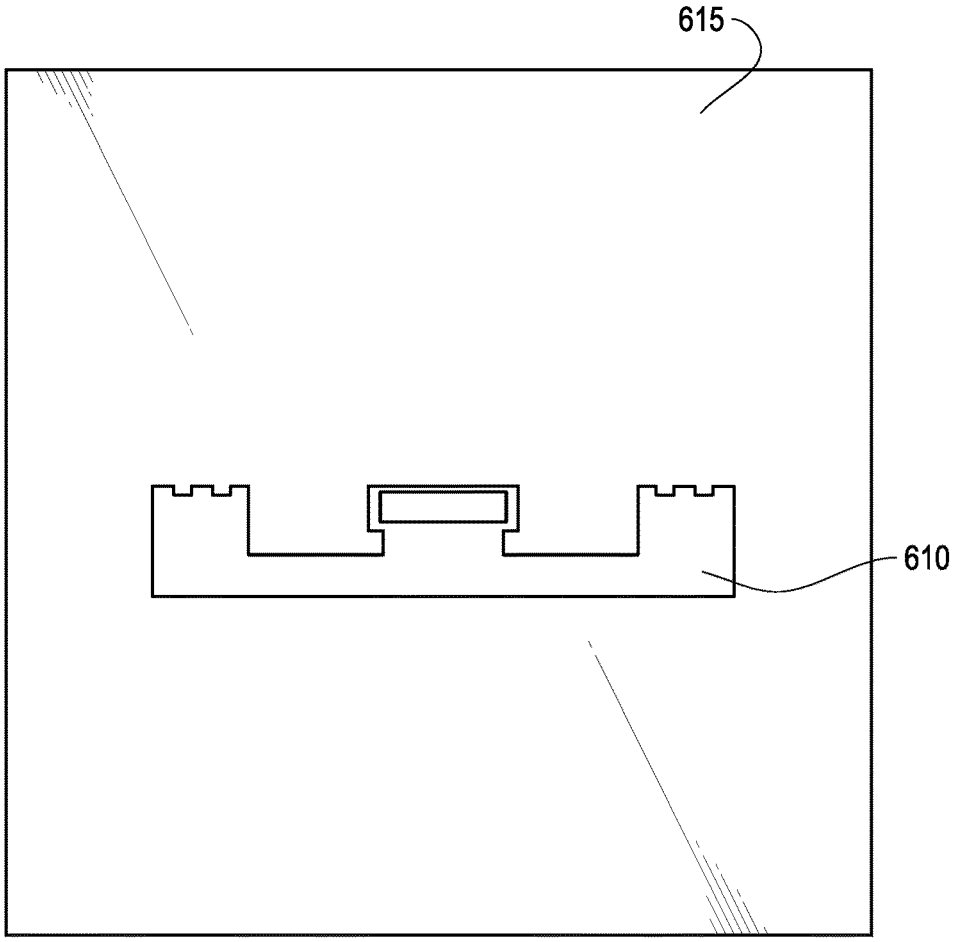
FIG. 6B is an RFID tag, according to an embodiment.

FIG. 6A illustrates a system 600 including an RFID tag 610 and an RFID reader 620, and FIG. 6B illustrates the RFID tag 610 in an exemplary implementation of an embodiment. As shown in FIG. 6A, the RFID system 600 includes an RFID tag 610 attached to glass 615, such as the glass of a window or windshield of an automobile. The RFID tag 610 includes an antenna (not shown in FIG. 6) that is matched to a chip such as an ASIC, where the antenna is made of an electrical conductor, such as copper, silver or aluminum. The RFID reader 620 and the RFID tag 610 communicate with each other, such that the automobile to which the RFID tag 610 is attached can be tracked. The antenna can be modified to match any ASIC parameters, and can be used across all ultra-high frequencies, so as to optimize performance of the antenna for a specific dielectric medium, such as a specific glass composition. Alternatively, the antenna can be modified so as to optimize performance in a single frequency band for different dielectric mediums, such as different glass compositions. The RFID tag antenna has a dual band structure, and thus has two resonances, and has several parameters that allow one to control the two resonances as well as the antenna impedance to yield good performance results. FIG. 6B illustrates an RFID tag 610, according to an embodiment. As shown in FIG. 6B, the tag is flush with the glass 615, with the ASIC and antenna facing the glass.

Figures 7, 8A, 8B:
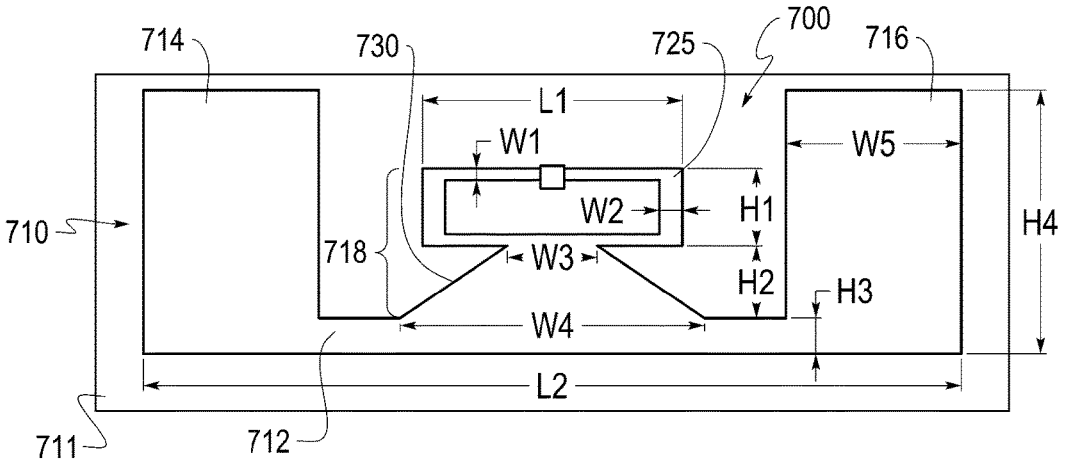
FIG. 7 is a top plane view of an antenna according to a first embodiment.
FIG. 8A is a table listing sizes of parameters of the antenna according to the first embodiment when designed in accordance with different frequency bands.
FIG. 8B is a table listing sizes of parameters of the antenna according to the first embodiment when designed in accordance with different frequency bands.

FIG. 7 is a top plane view of an RFID antenna 700 according to a first embodiment. As shown FIG. 7, the antenna 700 includes a radiator 710, which is disposed on a substrate 711. The radiator 710 includes a first electrical conductor 712, a second electrical conductor 714, and a third electrical conductor 716. The second electrical conductor 714 and the third electrical conductor 716 are symmetrical to each other with respect to a central point of the first electrical conductor 712. The antenna 700 includes a fourth electrical conductor 718, which includes a matching loop 725 and a feeding stub 730 that are disposed on the substrate 711. The stub 730 is disposed between the matching loop 725 and the first electrical conductor 712. Each of the second, third and fourth electrical conductors 714, 716, 718, respectively, perpendicularly intersect the first electrical conductor 712. The second electrical conductor 714 and the third electrical conductor 716 are stubs disposed at opposite ends of the first electrical conductor 712. The fourth electrical conductor 718 is disposed between the second electrical conductor 714 and the third electrical conductor 716. In the exemplary embodiment of FIG. 7, a total width of the stub 730 gradually decreases in a direction from the first electrical conductor 712 towards the matching loop 725.

The geometrical dimensions of the antenna 700 correspond to various parameters of the antenna 700, such as matching loop length, feeding stub width, radiator width, and overall antenna dimensions. These parameters are used to control two main resonances and antenna impedance for the RFID tag antenna, so as to match the ASIC parameters. This control of the geometric design of the antenna 700 enables the antenna to operate across all UHF frequencies (860-960 MHz) for a particular dielectric medium. Alternatively, the parameters may be used to control the antenna so that the antenna can be used in an RFID tag that operates in a single band (e.g., 910-930 MHz) for different dielectric mediums.

The parameters of the antenna 700 are illustrated in FIG. 7 with respect to the sizes of the various components of the antenna 700. For example, the loop 725 has a length L1 and a height H1. The loop 725 also has a first thickness, which is denoted as a width W1, and a second thickness, which is denoted as a width W2. The antenna 700 has overall dimensions defined by a length L2 and a height H4. Radiator 710 has a height H3, and the first electrical conductor 712 and the second electrical conductor 713 of the radiator 710 each have a width W5. The widest portion of the feeding stub 730 has a width W4, and the narrowest portion of the feeding stub 730 has a width W3.

The parameters L1, L2, H1, H2, H3, H4, W1, W2, W3, W4, W5 of the antenna 700 are used to control the antenna to match the ASIC parameters, where some overlap in parameter functionality may occur. For example, parameters L2, H3, W5, H4 may be used to mainly control the main antenna resonant frequency. Parameters L1, W1, H1, W2 may be used to mainly control the antenna reactance (i.e., fine adjustment of resonant frequency), but may also affect antenna resistance. Parameters H3, W4 may be used to mainly control antenna resistance, and parameters W3, W4, H2 may be used to mainly control the relative position/magnitude of the two antenna resonances, the relative magnitude of the two resonances, and the separation between the two resonances. This control of the geometric design of the antenna 700 enables the antenna to operate across all UHF frequencies (860-960 MHz) for a particular dielectric medium. Alternatively, the parameters may be used to control the antenna so that the antenna can be used in an RFID tag that operates in a single band (e.g., 910-930 MHz) for different dielectric mediums.

FIG. 8A and FIG. 8B are tables 800, 850, respectively, which list exemplary sizes of parameters of the antenna when the antenna 700 is designed with respect to different frequency bands. Within the UHF frequency range of 856-960 MHz, there are two primary subsets, namely, the FCC (US) standard frequency range of 902-928 MHz, and the ETSI (EU) standard frequency range of 866-869 MHz. The FCC standard is used throughout North America as well as the majority of the Caribbean and much of South America. The ETSI standard is used throughout the European Union and most countries adhering to EU standards. Various other subsets within the above ranges are used throughout the world. For example, Japan and some other Asian countries use a UHF band of 950-956 MHz. As shown in FIG. 8A, the table 800 provides the exemplary values of the parameters for the components of the RFID antenna 700 in terms of millimeters, when used according to ETSI at 865 MHz, and FCC at 915 MHz. As shown in FIG. 8B, the table 850 provides the exemplary values of the parameters for the components of the RFID antenna 700 in terms of wavelength, when used according to ETSI at 865 MHz, and FCC at 915 MHz.

Figure 9A:
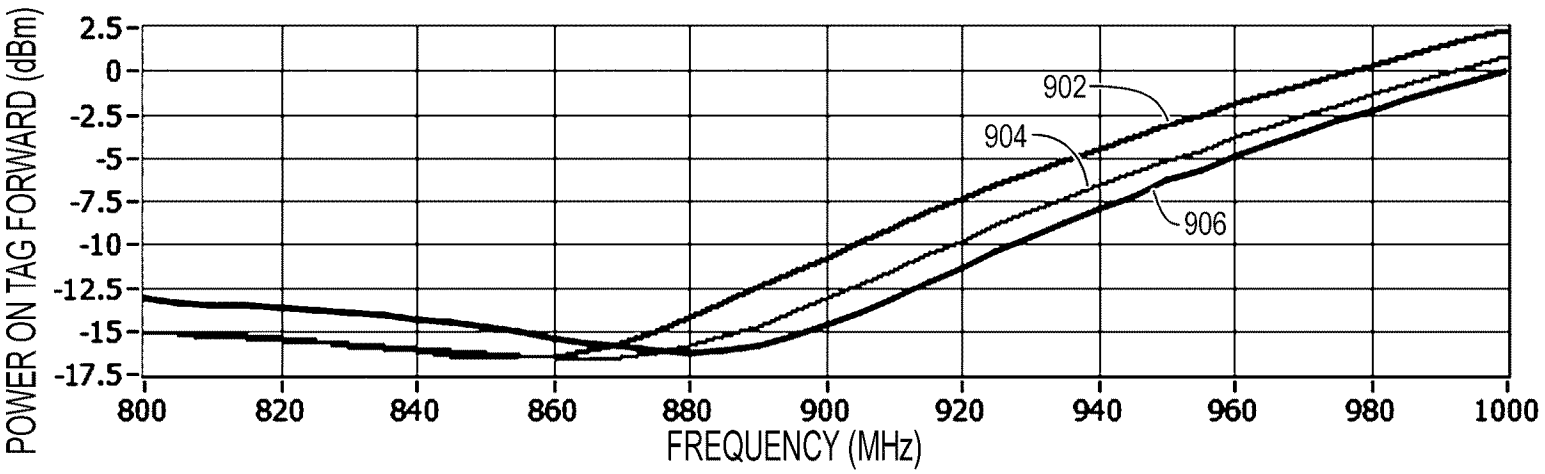
FIG. 9A is a graph illustrating tag performance of the antenna according to the first embodiment when attached to different types of material and when designed to operate in a first frequency band.
Figure 9B:
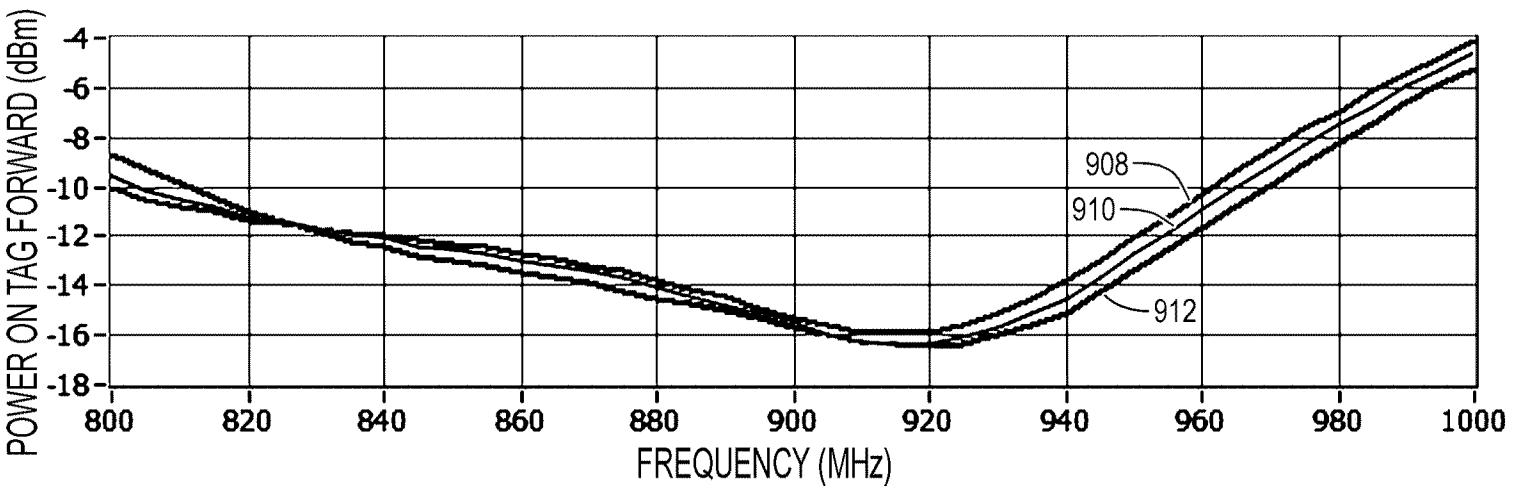
FIG. 9B is a graph illustrating tag performance of the antenna according to the first embodiment when attached to different types of material and when designed to operate in a second frequency band.

Tag sensitivity, which is the minimum threshold amount of power required for a tag to power on, is a parameter that affects the performance of UHF RFID tags. Tag sensitivity affects the maximum communication range of an RFID system, and affects the amount of power that can be back-scattered by the tag. The tag sensitivity threshold must be low to achieve longer read ranges. FIGS. 9A and 9B illustrate the measured tag performance, or tag sensitivity, using the antenna 700 when the tag is attached to various types of glass materials. FIG. 9A illustrates when the tag antenna 700 is designed in accordance with the ETSI frequency band, and FIG. 9B illustrates when the tag antenna 700 is designed in accordance with the FCC frequency band. Examples of various types of glass materials may include automobile glass of vehicles manufacturers such as Volkswagen®, KIA® and Chevrolet®, each of the automobile glasses of the different manufacturers having different dielectric properties. As shown in FIGS. 9A and 9B, the antenna 700 has similar performance when affixed to each of the different dielectric mediums.

In FIG. 9A and FIG. 9B, the horizontal axis represents frequency in units of Megahertz (MHz), and the vertical axis represents tag turn-on power in units of decibel-milliwatts (dBm). With reference to FIG. 9A, which illustrates when the tag antenna 700 is designed in accordance with the ETSI frequency band, curve 902 illustrates the tag sensitivity using the antenna 700 when the tag is attached to glass of a Chevrolet® automobile. Curve 904 illustrates the tag sensitivity using the antenna 700 when the tag is attached to glass of a Volkswagen® automobile, and curve 906 illustrates the tag sensitivity using the antenna 700 when the tag is attached to glass of a Kia® automobile.

With reference to FIG. 9B, which illustrates when the tag antenna 700 is designed in accordance with the FCC frequency band, curve 908 illustrates the tag sensitivity using the antenna 700 when the tag is attached to glass of a Chevrolet® automobile. Curve 910 illustrates the tag sensitivity using the antenna 700 when the tag is attached to glass of a Kia® automobile, and curve 912 illustrates the tag sensitivity using the antenna 700 when the tag is attached to glass of a Volkswagen® automobile.

Figures 10, 11A, 11B:
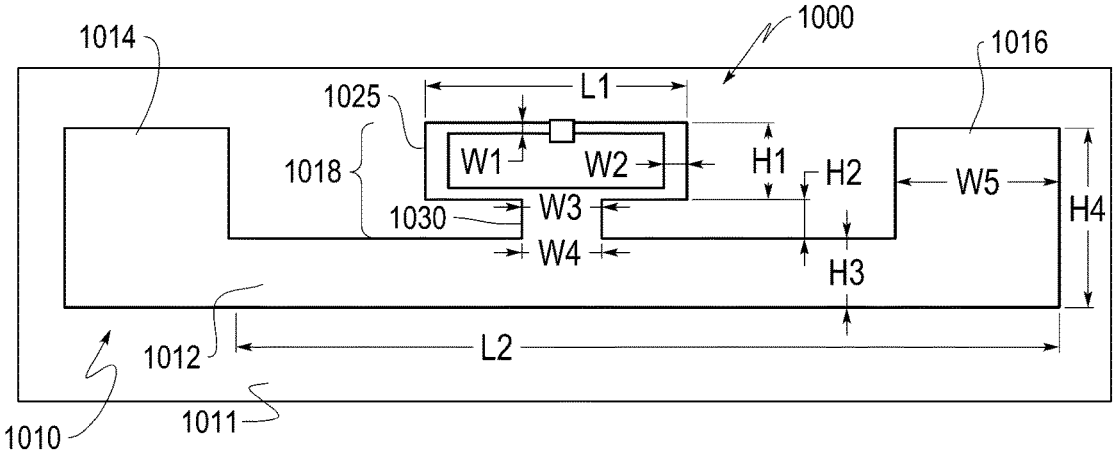
FIG. 10 is a top plane view of an antenna according to a second embodiment.
FIG. 11A is a table listing sizes of parameters of the antenna according to the second embodiment when designed in accordance with a specific frequency band.
FIG. 11B is a table listing sizes of parameters of the antenna according to the first embodiment when designed in accordance with a specific frequency band.

FIG. 10 is a top plane view of an RFID antenna 1000 according to a second embodiment. As shown FIG. 10, the antenna 1000 includes a radiator 1010, which is disposed on a substrate 1011. The radiator 1010 includes a first electrical conductor 1012, a second electrical conductor 1014, and a third electrical conductor 1016. The second electrical conductor 1014 and the third electrical conductor 1016 are symmetrical to each other with respect to a central point of the first electrical conductor 1012. The antenna 1000 includes a fourth electrical conductor 1018, which includes a matching loop 1025 and a feeding stub 1030 that are disposed on the substrate 1011. The stub 1030 is disposed between the matching loop 1025 and the first electrical conductor 1012. Each of the second, third and fourth electrical conductors 1014, 1016, 1018, respectively, perpendicularly intersect the first electrical conductor 1012. The second electrical conductor 1014 and the third electrical conductor 1016 are stubs disposed at opposite ends of the first electrical conductor 1012. The fourth electrical conductor 1018 is disposed between the second electrical conductor 1014 and the third electrical conductor 1016. In the exemplary embodiment of FIG. 10, a total width of the stub 1030 remains constant in a direction from the first electrical conductor 1012 towards the matching loop 1025.

The parameters of the antenna 1000 are illustrated in FIG. 10 with respect to the sizes of the various components of the antenna 1000. For example, the loop 1025 has a length L1 and a height H1. The loop 1025 also has a first thickness, which is denoted as a width W1, and a second thickness, which is denoted as a width W2. The antenna 1000 has overall dimensions defined by a length L2 and a height H4. Radiator 1010 has a height H3, and the first electrical conductor 1012 and the second electrical conductor 1013 of the radiator 1010 each have a width W5. In the exemplary embodiment of FIG. 10, an upper portion of the feeding stub 1030 has a width W4, and a lower portion of the feeding stub 0130 has a width W3. A total width of the stub 1030 remains constant in a direction from the first electrical conductor 1012 towards the matching loop 1025. Thus, in the exemplary embodiment of FIG. 10, W3 equals W4.

The parameters L1, L2, H1, H2, H3, H4, W1, W2, W3, W4, W5 of the antenna 1000 are used to control the antenna to match the ASIC parameters, where some overlap in parameter functionality may occur. For example, parameters L2, H3, W4, H4 may be used to mainly control the main antenna resonant frequency. Parameters L1, W1, H1, W2 may be used to mainly control the antenna reactance (i.e., fine adjustment of resonant frequency), but may also affect antenna resistance. Parameters H3, W4 may be used to mainly control antenna resistance, and parameters W3, W4, H2 may be used to mainly control the relative position/magnitude of the two antenna resonances, the relative magnitude of the two resonances, and the separation between the two resonances. This control of the geometric design of the antenna 1000 enables the antenna to operate across all UHF frequencies (860-960 MHz) for a particular dielectric medium. Alternatively, the parameters may be used to control the antenna so that the antenna can be used in an RFID tag that operates in a single band (e.g., 910-930 MHz) for different dielectric mediums.

FIG. 11A and FIG. 11B are tables 1100, 1150, respectively, which list exemplary sizes of parameters of the antenna when the antenna 1000 is designed with respect to a specific frequency band. As shown in FIG. 11A, the table 1100 provides the exemplary values of the parameters for the components of the RFID antenna 1000 in terms of millimeters, when used according to FCC at 915 MHz. As shown in FIG. 11B, the table 1150 provides the exemplary values of the parameters for the components of the RFID antenna 1000 in terms of wavelength, when used according to FCC at 915 MHz.

Figure 12:
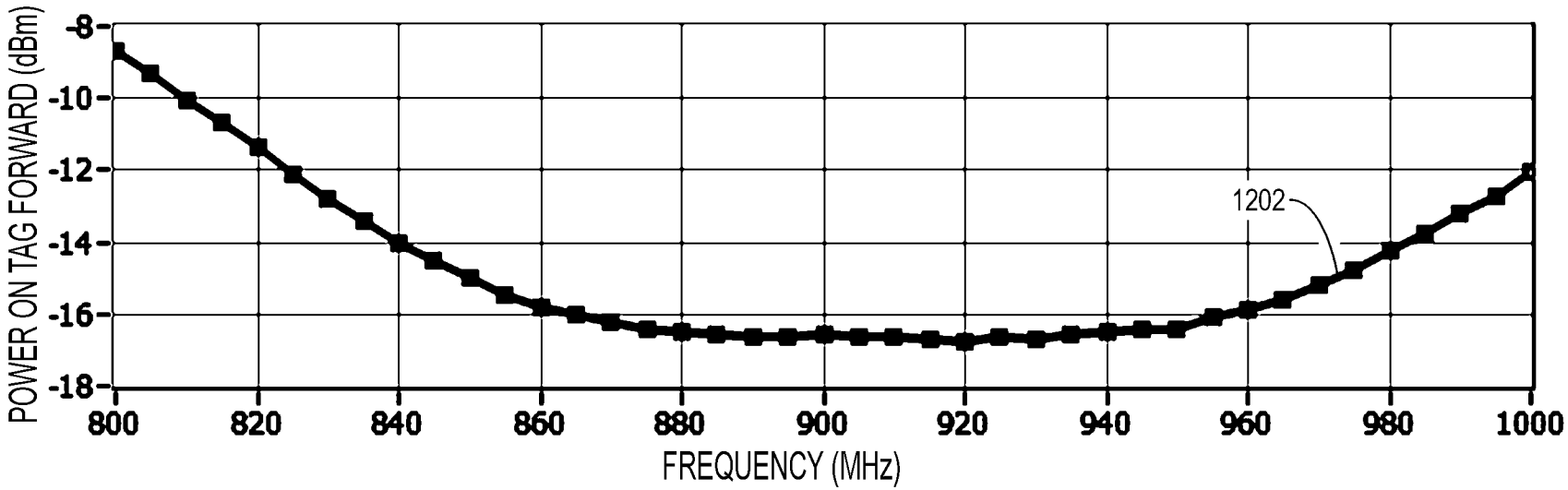
FIG. 12 is a graph illustrating tag performance of the antenna according to the second embodiment when attached to a specific type of material and when the antenna is designed to operate in multiple frequency bands.

FIG. 12 illustrates the measured tag performance, or tag sensitivity, using the antenna 1000 when the tag is attached to a specific glass material and when the antenna is designed to operate in multiple frequency bands. The horizontal axis represents frequency in units of Megahertz (MHz), and the vertical axis represents tag turn-on power in units of decibel-milliwatts (dBm). As shown in FIG. 12, the specific glass material may include automobile glass of a vehicle manufacturer such as Volkswagen®. The curve 1202 illustrates a tag sensitivity that is better than −16.5 dBm across a 100 MHz band (e.g., 860 MHz-960 MHz). This is an example of global usage of the tag on a specific automobile glass material.

Figure 13:
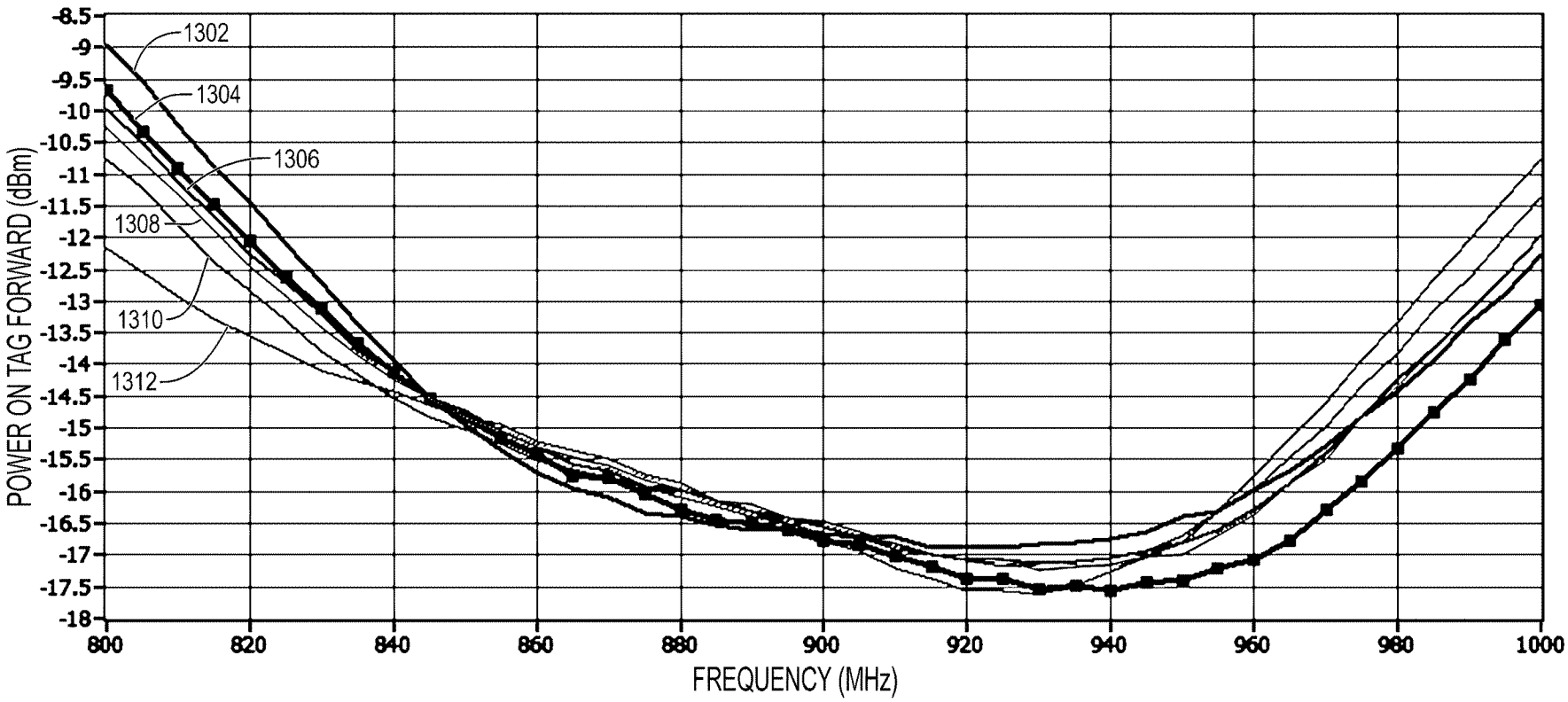
FIG. 13 is a graph illustrating tag performance of the antenna according to the second embodiment when attached to different types of material and when designed to operate in a second frequency band.

FIG. 13 is a graph illustrating tag performance of the antenna 1000 when the tag is attached to different types of material, and when designed to operate across all UHF frequencies (860 MHz-960 MHz). The horizontal axis represents frequency in units of Megahertz (MHz), and the vertical axis represents tag turn-on power in units of decibel-milli-watts (dBm). Examples of various types of glass materials may include automobile glass of vehicles manufacturers such as Volkswagen®, Kia® and Chevrolet®, Mazda® and BMW®, and a generic type of that is not associated with a specific manufacturer. Each of the automobile glasses has different dielectric properties. As shown in FIG. 13, the tag sensitivity is greater than −16.5 dBm in the 910 MHz-930 MHz band for all the glass types, curve 902 illustrates the tag sensitivity using the antenna 700 when the tag is attached to glass of a Chevrolet® automobile.

In FIG. 13 illustrates an example of single band usage of the tag on a variety of different automobile glass materials. Curve 1302 illustrates the tag sensitivity using the antenna 700 when the tag is attached to glass of a Volkswagen® automobile, and curve 1304 illustrates the tag sensitivity using the antenna 700 when the tag is attached to glass of a Kia® automobile. Curve 1306 illustrates the tag sensitivity using the antenna 700 when the tag is attached to glass of a BMW® automobile, and curve 1308 illustrates the tag sensitivity using the antenna 700 when the tag is attached to glass of a Mazda® automobile. Curve 1310 illustrates the tag sensitivity using the antenna 700 when the tag is attached to glass of a Chevrolet® automobile, and curve 1312 illustrates the tag sensitivity using the antenna 700 when the tag is attached to glass of a generic type that is not associated with a specific manufacture.

Figure 14:
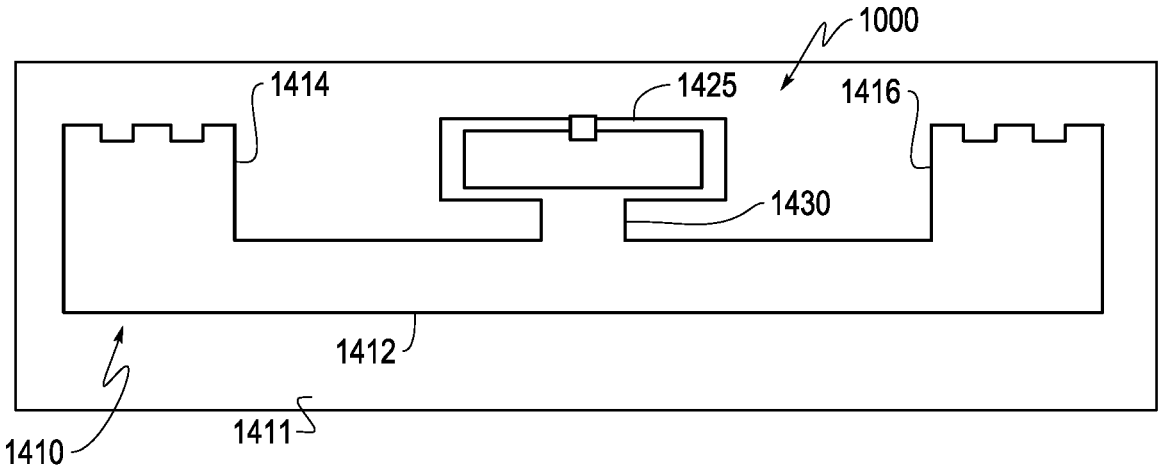
FIG. 14 is a top plane view of an antenna according to a third embodiment.

A third embodiment is illustrated in FIG. 14, which is a top plane view of an RFID antenna 1400. As shown FIG. 14, the antenna 1400 includes a radiator 1410, which is disposed on a substrate 1411. The radiator 1410 includes a first electrical conductor 1412, a second electrical conductor 1414, and a third electrical conductor 1416. The second electrical conductor 1414 and the third electrical conductor 1416 are symmetrical to each other with respect to a central point of the first electrical conductor 1412. A side of the second electrical conductor 1414 that is opposite to a side of the first electrical conductor 1412 has a "castle top" structure, which includes alternating protrusions and recesses, thereby providing a smaller form factor than that of the A side of the third electrical conductor 1416 that is opposite to a side of the first electrical conductor 1412 also has a "castle top" structure. The antenna 1400 includes a fourth electrical conductor 1418, which includes a matching loop 1425 and a feeding stub 1430 that are disposed on the substrate 1411. The stub 1430 is disposed between the matching loop 1425 and the first electrical conductor 1412. Each of the second, third and fourth electrical conductors 1414, 1416, 1418, respectively, perpendicularly intersect the first electrical conductor 1412. The second electrical conductor 1414 and the third electrical conductor 1416 are stubs disposed at opposite ends of the first electrical conductor 1412. The fourth electrical conductor 1418 is disposed between the second electrical conductor 1414 and the third electrical conductor 1416. In the exemplary embodiment of FIG. 14, a total width of the stub 1430 remains constant in a direction from the first electrical conductor 1412 towards the matching loop 1425.

Figure 15:
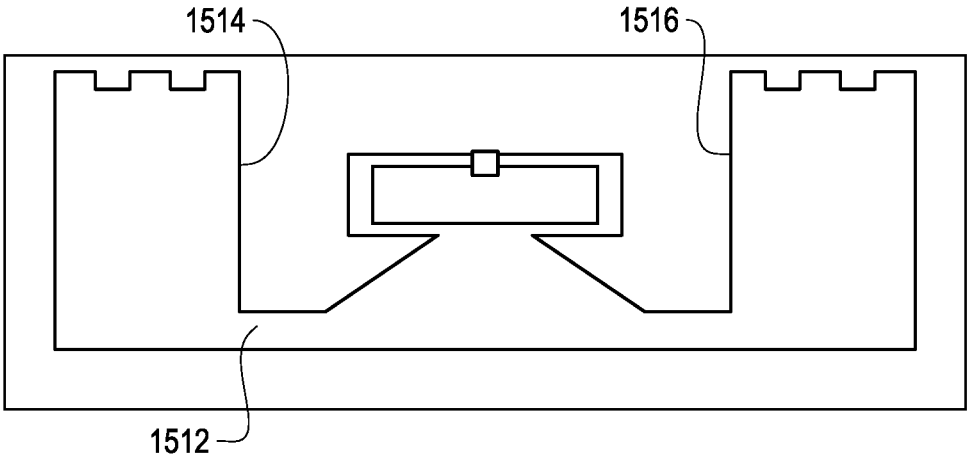
FIG. 15 is a top plane view of an antenna according to a fourth embodiment.

Likewise, a fourth embodiment may include an antenna 700, like the antenna shown in FIG. 7, but further including a "castle top" structure. For example, with reference to the fourth embodiment shown in FIG. 15, the antenna 1500 illustrates the "castle top" structure, where a side of the second electrical conductor 1514 that is opposite to a side of the first electrical conductor 1512 includes alternating protrusions and recesses. Furthermore, a side of the third electrical conductor 1516 that is opposite to a side of the first electrical conductor 1512 may also have a "castle top" structure.

Figure 16A:
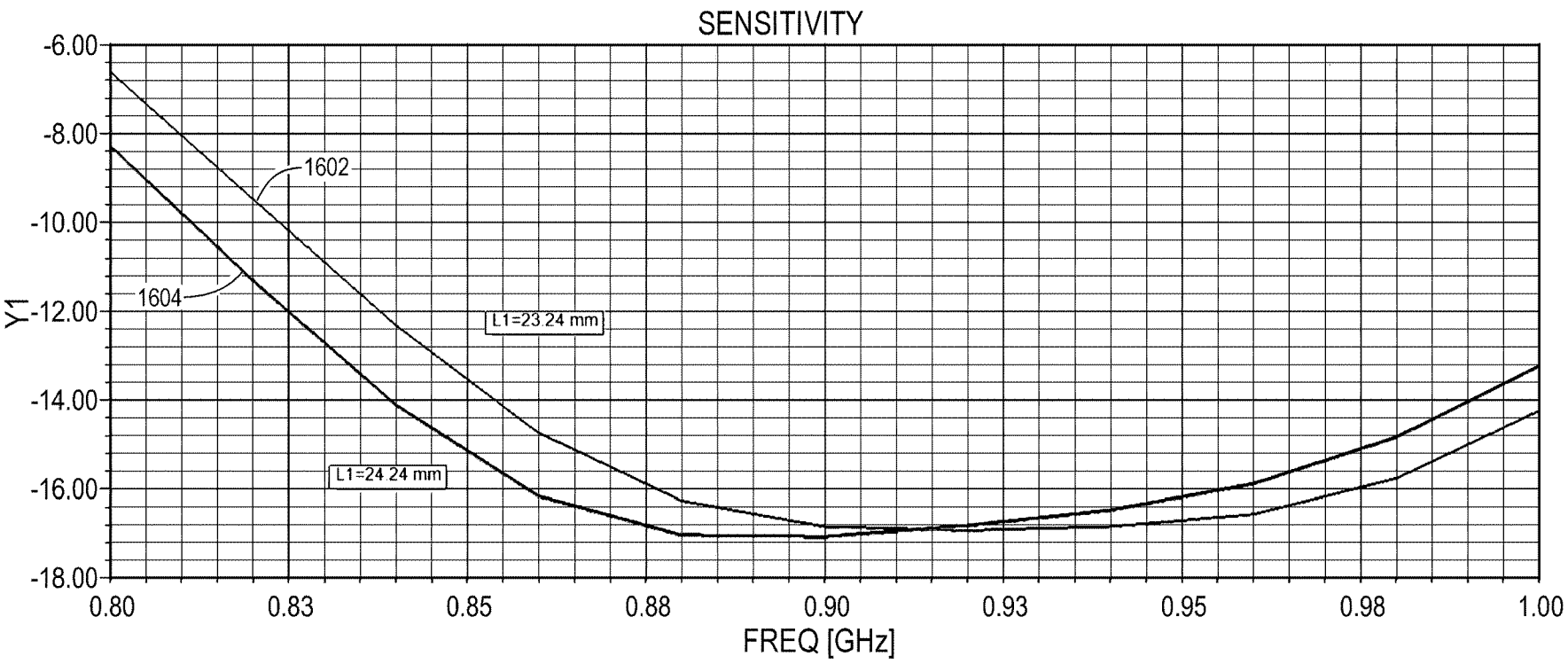
FIG. 16A is a graph illustrating tag performance of an antenna according to an embodiment.
Figure 16B:
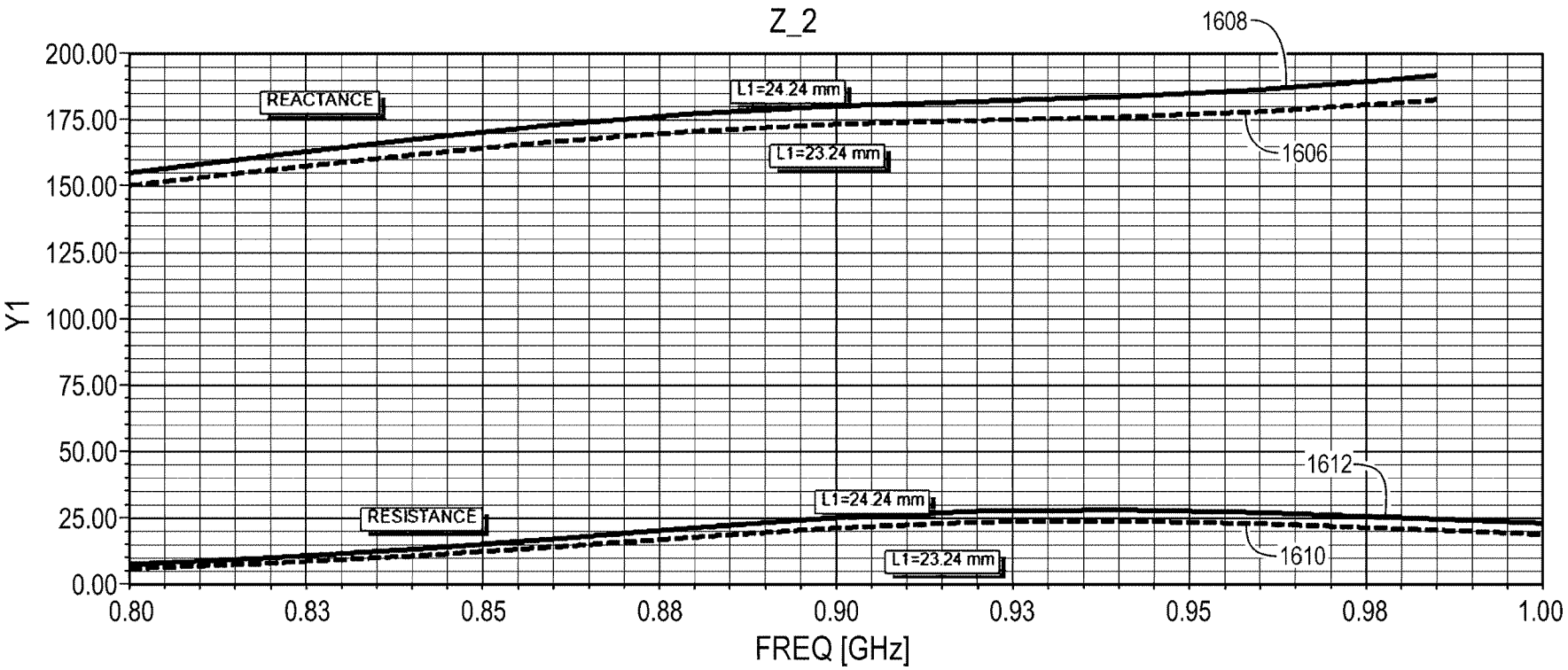
FIG. 16B is a graph illustrating tag performance of an antenna according to an embodiment.
Figure 16C:
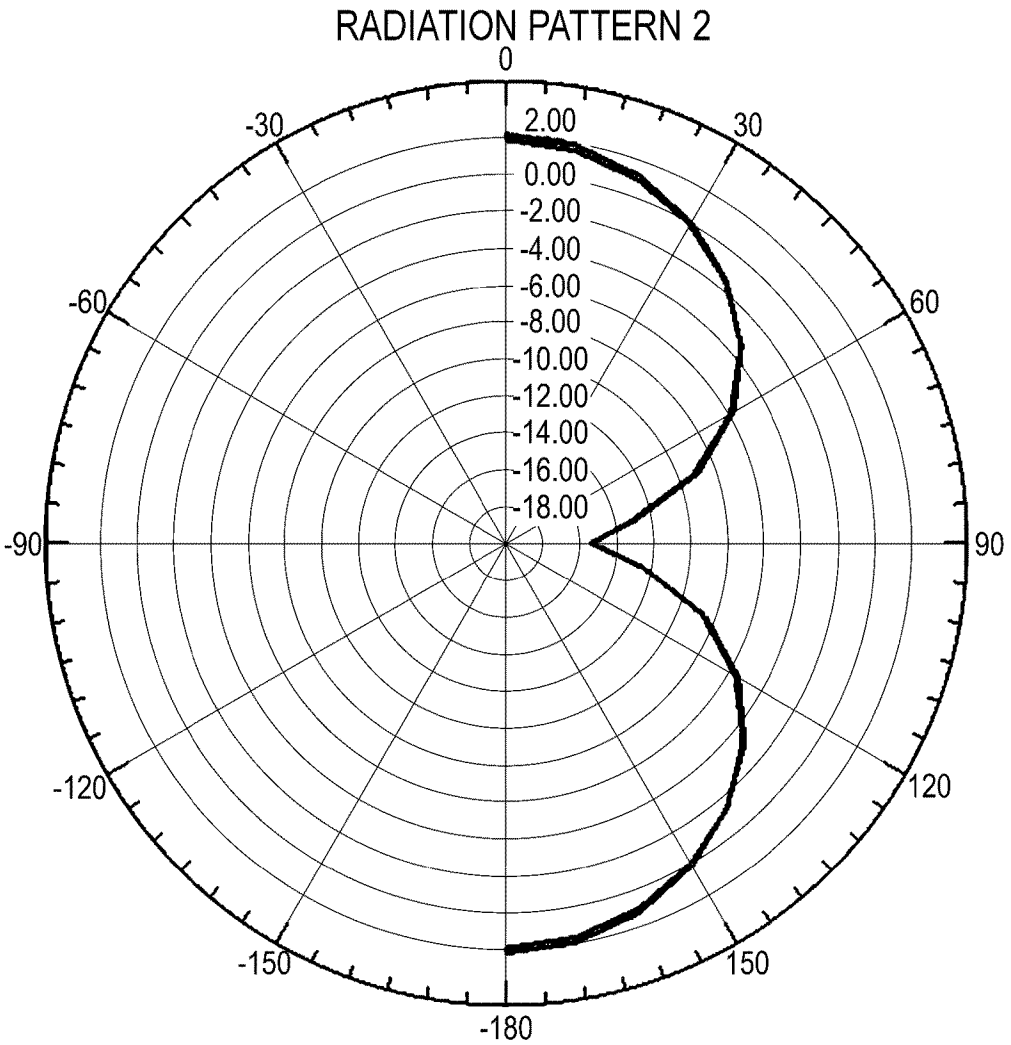
FIG. 16C is a chart of a radiation pattern of an antenna according to an embodiment.

FIGS. 16A, 16B and 16C illustrate the effect of changing one of the parameters of an antenna. For example, with reference to FIG. 10 and FIG. 11A, the parameter L1 of the antenna 1000 may be changed from 23.34 mm to 25.24 mm, with the remaining parameters being unchanged. In FIG. 16A, the horizontal axis represents frequency in units of Gigahertz (GHz), and the vertical axis represents tag turn-on power in units of decibel-milli-watts (dBm). Curve 1602 illustrates the tag when L1 equals 23.24 mm, and curve 1604 illustrates when L1 is changed to 25.24. As shown in FIG. 16A, the changing of L1 from 23.34 to 25.24 results in curve 1604 retaining the shape as curve 1602, while curve 1604 shifts to a lower frequency band.

As shown in FIG. 16B, while the tag sensitivity curve shifts to a lower frequency band (FIG. 16A) when L1 is changed from 23.34 mm to 25.24 mm, the reactance changes, as indicated by the change from curve 1606 to curve 1608. Likewise, in FIG. 16B, the resistance changes, as indicated by the change from curve 1610 to curve 1612. As shown in FIG. 16C, the gain of the antenna remains virtually unchanged when L1 is changed from 23.34 mm to 25.24 mm.

It is understood that implementations of antenna devices and antenna device systems according to aspects and features of the invention are applicable to numerous and different types of technologies, industries, and devices. For example, additional implementations not specifically discussed above can include applications to glass materials other than automobile glass materials, and applications to materials other than glass materials.

These and other changes can be made to the invention in light of the above Detailed Description. While the above description describes certain examples, and describes the best mode contemplated, no matter how detailed the above appears in text, the invention can be practiced in many ways. Details of the system may vary considerably in its specific implementation, while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific examples disclosed in the specification, unless the above Detailed Description section explicitly defines such terms. Accordingly, the actual scope of the invention encompasses not only the disclosed examples, but also all equivalent ways of practicing or implementing the invention under the claims.

While certain aspects of the invention are presented below in certain claim forms, the applicant contemplates the various aspects of the invention in any number of claim forms.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description has been presented for purposes of illustration and description, but is not intended to be exhaustive or limited to embodiments of the invention in the form disclosed. Many modifications and variations will be apparent to those of ordinary skill in the art without departing from the scope and spirit of embodiments. The embodiment was chosen and described in order to explain the principles of embodiments and the practical application, and to enable others of ordinary skill in the art to understand embodiments of the invention for various embodiments with various modifications as are suited to the particular use contemplated.

Although specific embodiments have been illustrated and described herein, those of ordinary skill in the art appreciate that any arrangement which is calculated to achieve the same purpose may be substituted for the specific embodiments shown and that embodiments have other applications in other environments. This application is intended to cover any adaptations or variations of the present invention. The following claims are in no way intended to limit the scope of embodiments of the invention to the specific embodiments described herein.

What is claimed is:

1. A radio frequency identification (RFID) antenna comprising:

a substrate;

a radiator disposed on the substrate, the radiator having a first height, the radiator comprising:

a plurality of electrical conductors comprising:

a first electrical conductor;

a second electrical conductor;

a third electrical conductor; and a fourth electrical conductor, wherein each of the second, third and fourth electrical conductors perpendicularly intersect the first electrical conductor, wherein the second electrical conductor and the third electrical conductor comprise stubs disposed at opposite ends of the first electrical conductor, and wherein the fourth electrical conductor is disposed between the second electrical conductor and the third electrical conductor, the fourth electrical conductor comprising a loop and a feeding stub disposed between the loop and the first electrical conductor, wherein a widest portion of the feeding stub has a first width and a narrowest portion of the feeding stub has a second width, and wherein the feeding stub has a second height, such that:

a first resonance and a second resonance of the RFID antenna is controlled based on a function of the first width, second width, and second height, and an antenna resistance of the RFID antenna is controlled based on a function of the first height and the first width.

2. The RFID antenna according to claim 1, where the loop is formed in the shape of a polygon.

3. The RFID antenna according to claim 2, wherein the polygon is a rectangle.

4. The RFID antenna according to claim 1, wherein a total width of the feeding stub gradually decreases in a direction from the first electrical conductor towards the loop.

5. The RFID antenna according to claim 1, wherein a total width of the feeding stub remains constant in a direction from the first electrical conductor towards the loop.

6. The RFID antenna according to claim 1, wherein the second electrical conductor and the third electrical conductor are symmetrical to each other with respect to a central point first electrical conductor.

7. The RFID antenna according to claim 1, wherein the antenna is configured to operate at ultra-high frequencies from 860 MHz to 960 MHz.

8. The RFID antenna according to claim 1, wherein when a central operating frequency is 865 MHz, a length of the loop is 0.073λ., and a height of the loop is 0.02λ.

9. The RFID antenna according to claim 1, wherein when a central operating frequency is 915 MHz, a length of the loop is 0.075λ., and a height of the loop is 0.018λ.

10. The RFID antenna according to claim 1, wherein the first, second, third and fourth electrical conductors form an integral electrical conductor.

11. The RFID antenna according to claim 1, wherein a side of the second electrical conductor that is opposite to a side of the first electrical conductor includes alternating protrusions and recesses, and a side of the third electrical conductor that is opposite to a side of the first electrical conductor includes alternating protrusions and recesses.

12. The RFID antenna according to claim 1, wherein the RFID antenna is a dual band antenna.

13. The RFID antenna according to claim 12, wherein resonance of the antenna is determined, at least in part, by a height of the second electrical conductor, a height of the third electrical conductor, a total width of the feeding stub, and a total width of the loop.

14. A radio frequency identification (RFID) antenna comprising:

a substrate;

a radiator disposed on the substrate and having a first height, the radiator comprising a first electrical conductor and a second electrical conductor that perpendicularly intersect an edge of the radiator, the first electrical conductor and the second electrical conductor being symmetrical to each other with respect to a central point of the radiator;

a loop disposed on the substrate; and a feeding stub disposed on the substrate between the loop and the central point of the radiator, wherein a widest portion of the feeding stub has a first width and a narrowest portion of the feeding stub has a second width, and wherein the feeding stub has a second height, such that:

a first resonance and a second resonance of the RFID antenna is controlled based on a function of the first width, second width, and second height, and an antenna resistance of the RFID antenna is controlled based on a function of the first height and the first width.

15. The RFID antenna according to claim 14, where the loop is formed in the shape of a polygon.

16. The RFID antenna according to claim 15, wherein the polygon is a rectangle.

17. The RFID antenna according to claim 14, wherein a total width of the feeding stub gradually decreases in a direction from the straight edge of the radiator towards the loop.

18. The RFID antenna according to claim 14, wherein a total width of the feeding stub remains constant in a direction from the straight edge of the radiator towards the loop.

19. The RFID antenna according to claim 14, wherein the RFID antenna is a dual band antenna.

20. A radio frequency identification (RFID) tag comprising:

a substrate;

an integrated circuit disposed on the substrate, the integrated circuit having an input terminal, the input terminal having an input impedance; and an RFID antenna disposed on the substrate, the RFID antenna having a feed terminal coupled to the input terminal of the integrated circuit, wherein the feed terminal has a terminal impedance, the RFID antenna comprising:

a radiator disposed on the substrate and having a first height, the radiator comprising a first electrical conductor and a second electrical conductor that perpendicularly intersect a straight edge of the radiator, the first electrical conductor and the second electrical conductor being symmetrical to each other with respect to a central point of the radiator;

a loop disposed on the substrate; and a feeding stub disposed on the substrate between the loop and the central point of the radiator, wherein the feeding stub is coupled to the feed terminal, wherein a widest portion of the feeding stub has a first width and a narrowest portion of the feeding stub has a second width, and wherein the feeding stub has a second height, such that:

a first resonance and a second resonance of the RFID antenna is controlled based on a function of the first width, second width, and second height, and an antenna resistance of the RFID antenna is controlled based on a function of the first height and the first width.

* * * * *